United States Patent [19]

Benatar

[11] 4,212,331

[45] Jul. 15, 1980

[54] PRESSURIZED APPARATUS FOR DISCHARGING POWDERED REAGENT FROM A SHIPPING CONTAINER

[76] Inventor: Victor Benatar, 1191 Hopkins Ter., Atlanta, Ga. 30324

[21] Appl. No.: 965,400

[22] Filed: Dec. 1, 1978

[51] Int. Cl.[3] ..... B65B 1/16

[52] U.S. Cl. ..... 141/67; 141/83; 141/284; 141/311 R; 406/12; 406/23

[58] Field of Search ..... 141/18, 67, 68, 83, 141/231, 232, 250, 284, 311 R, 312, 346; 177/50, 114, 122; 406/12, 23–25

[56] References Cited

U.S. PATENT DOCUMENTS

| | | | |
|---|---|---|---|
| 1,598,128 | 8/1926 | Gase | 177/122 |
| 3,188,144 | 6/1965 | Gmur et al. | 406/23 X |
| 3,297,064 | 1/1967 | Moore et al. | 141/346 X |
| 3,958,700 | 5/1976 | Foy et al. | 141/284 X |

*Primary Examiner*—Frederick R. Schmidt

*Attorney, Agent, or Firm*—Walter M. Rodgers; Walter A. Rodgers

[57] ABSTRACT

A shipping container having powdered reagent therein is mounted atop a transition chamber disposed on suitable support structure so that the contents of the shipping container may be discharged through a valve thereon and through the transition chamber into a dispenser vessel supported by weighing means suspended from the support structure and interconnected with the transition chamber by a yieldable coupling arranged to provide a fluid-tight connection between the transition chamber and the dispenser vessel irrespective of the weight of the contents of the dispenser vessel and a pair of conduits controlled by a common valve are arranged to supply pressure fluid such as an inert gas from a source under pressure into the transition chamber and into the shipping container in coordination with the mounting of the shipping container on a part of the transition chamber.

13 Claims, 2 Drawing Figures

PRESSURIZED APPARATUS FOR DISCHARGING POWDERED REAGENT FROM A SHIPPING CONTAINER

TECHNICAL FIELD

Finely powdered material such as calcium carbide or magnesium is supplied to molten ferrous metal in order to effect a desulfurizing action as is discussed in U.S. Pat. No. 3,929,464 issued Dec. 30, 1975 and titled "Desulfurization of Molten Ferrous Metals", calcium carbide reacts with moisture to form acetylene gas and is quite volatile when exposed to atmospheric air. Thus it is necessary to supply this material to its point of use via suitable means such as shipping containers and other apparatus which contain an inert gas under pressure so as to isolate the material from atmospheric air and from moisture.

BACKGROUND ART

Known shipping containers for material such as calcium carbide include means for supplying inert gas under pressure to the container interior and also include telescopically related tubular elements arranged to conduct the material discharged from such a container into a point of use and such telescopic means may be pressurized by inert gas. Representative of the above described background art is U.S. Pat. No. 3,018,021 issued Jan. 23, 1962 and titled "Shipping Container".

DISCLOSURE OF INVENTION

According to this invention in one form, a shipping container filled with powdered reagent is mounted atop a transition chamber supported by support structure at the point of use and is arranged so that a material handling passage in a wall of the shipping container is aligned with the upper inlet of the transition chamber and the outlet of the transition chamber is connected through yieldable coupling means in fluid-tight relation with a dispenser vessel suspended by weighing means supported by the support structure while control means activated by the mounting of the shipping container on a part of the transition chamber is arranged to supply inert gas from a source of inert gas under pressure through a common control valve and through conduit means to the interior of both the shipping container and the transition chamber, and quick disconnect means is provided for interconnecting the conduit means with the shipping container through suitable valve means.

BEST MODE OF CARRYING OUT THE INVENTION

Figure 1:
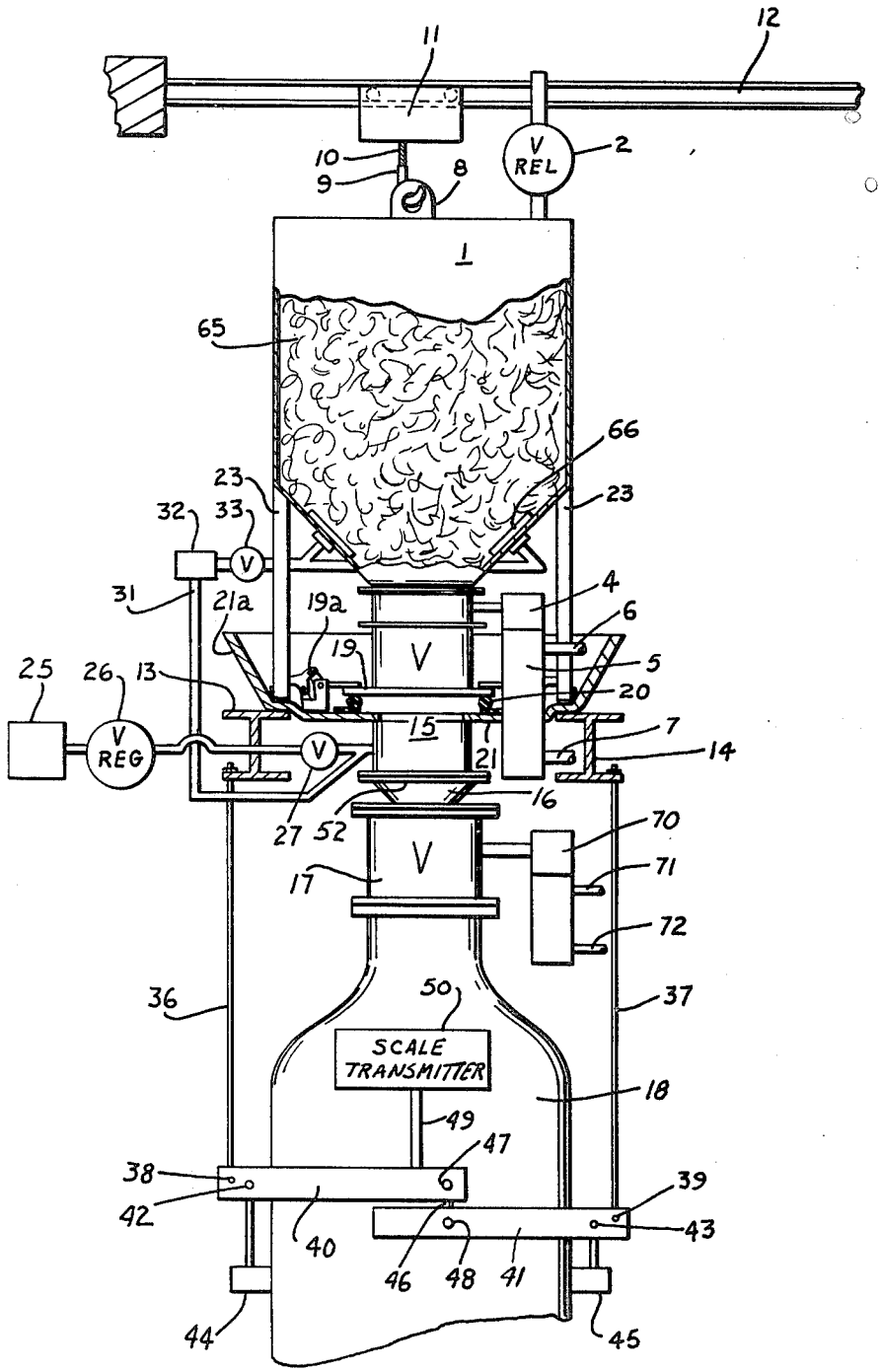
FIG. 1 is an overall schematic view of apparatus formed according to the invention.

In the drawings the numeral 1 generally designates a shipping container for powdered reagent material such for example as calcium carbide in finely divided form as discussed, for example, in U.S. Pat. No. 3,929,464. Shipping container 1 is provided with a relief valve 2 adjusted to discharge pressure from shipping container 1 which is above a predetermined safe level. Shipping container 1 is also provided with a valve 3 which controls a material handling passage formed in the lower part of shipping container 1. Valve 3 may be manually controlled as by the manually operable control mechanism 4 or, if desired, valve 3 may be controlled by a pneumatic means (or other remotely controlled means) schematically represented at 5 which is activated by gas under pressure supplied through conduits 6 and 7 in known manner. Shipping container 1 also is provided with suitable brackets such as that schematically represented by the numeral 8 which cooperates with a hook 9 and a cable 10 controlled by a mobile hoist 11 mounted on fixed monorail 12 which is disposed above the point of use of the reagent material in shipping container 1.

For supporting the structure as shown in FIG. 1, suitable support structure schematically indicated at 13 and 14 is provided and is mounted on the floor of the foundry by any known suitable means so that when valve 3 is opened the contents of shipping container 1 may be discharged through the transition chamber generally designated at 15 thence through yieldable coupling means generally designated at 16 through valve 17 when opened and into the dispenser vessel generally designated at 18 from whence the material is supplied by known means to molten ferrous metal to effect desulfurization thereof.

Since the powdered reagent used in a process such as the desulfurization of ferrous metal is deleteriously affected by exposure to air or to moisture, it is vital that the powdered reagent material be protected from atmospheric air. To this end the shipping container 1, the transition chamber 15, and the dispenser vessel 18 are supplied with inert gas and are maintained under pressure above atmospheric pressure.

Figure 2:
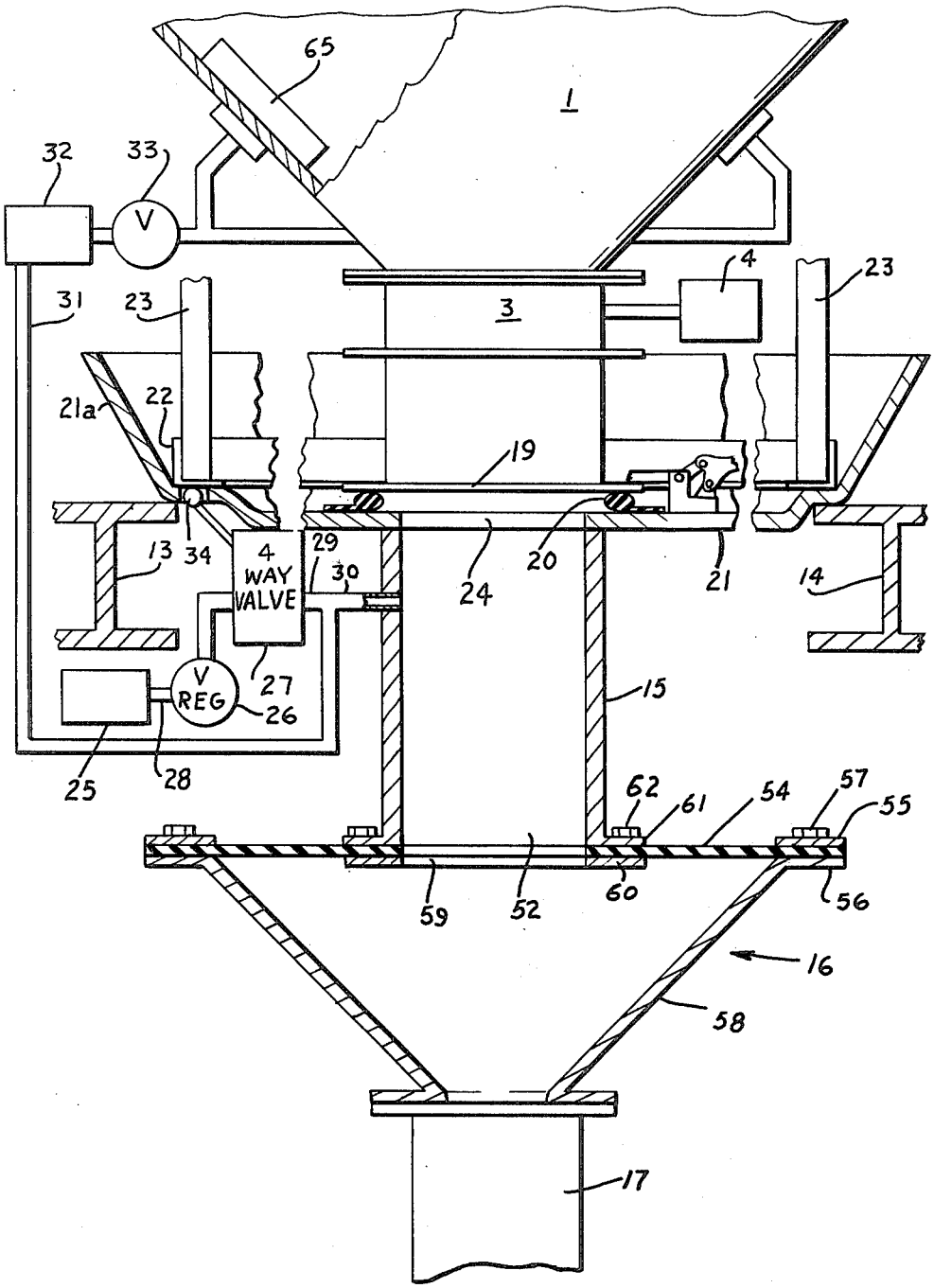
FIG. 2 is an enlarged cross-sectional view of a part of the arrangement shown in FIG. 1 which part is constructed according to certain aspects of this invention.

When moved into position on the monorail 12 and lowered by the cable 9 and associated mechanism 11 into its service position, and as best shown in FIG. 2, the flange 19 at the lower part of valve 3 is disposed atop the resilient sealing ring 20 which in turn is supported on base plate 21 which forms an integral part of transition chamber 15. Manually or pneumatically operable clamps **19*a* are secured to base plate 21 and are engageable with flange 19 to form a fluid-tight seal between valve 3 and transition chamber 15**.

In order properly to position the flange 19 relative to the transition chamber 15 and the seal 20, the base plate 21 is provided with an upwardly extending outwardly flared guide means **21*a* which engages the lower circular angle iron 22 which forms a part of the support structure for the shipping container 1 and which is interconnected therewith by means of vertically disposed support posts 23 secured at their upper ends in known manner with the body portion of shipping container 1. Guide means 21*a* could take the form of a circular element as shown or could constitute a plurality of three or more individual elements having inclined surfaces as is obvious. Thus as is obvious from FIG. 2, lowering of shipping container 1 and of its circular lower support ring 22 causes this ring to engage the downwardly inclined wall of the guide means 21 and thus insures proper coaxial alignment of the shipping container 1 with the transition chamber 15 so that the material handling passage through the valve 3 of shipping container 1 is aligned with the inlet 24 of transition chamber 15**.

For the purpose of supplying an inert gas under pressure to the interior of transition chamber 15 and to the interior of shipping container 1, a source of inert gas under pressure indicated by the numeral 25 is provided and is connected through a pressure regulator 26 with a common valve 27. Valve 27 is provided with conduit means in the form of an inlet conduit 28, an outlet conduit 29, a conduit 30 which is connected with the transition chamber 15 together with a conduit 31 which is interconnected through quick disconnect coupling 32 and manually controllable valve 33 with the interior of shipping container 1. By this means inert gas such as nitrogen is maintained under pressure within the shipping container 1 and the transition chamber 15.

In order automatically to supply inert gas to the interior of transition chamber 15 and shipping container 1, automatic control means is provided and includes control means 34 mounted on base plate 21 and engageable by part 22 of the support for container 1 so that once the shipping container 1 is lowered into the position shown in the drawings, control means 34 is automatically actuated and pressure is thus automatically supplied through the conduit means including conduits 30 and 31 to the interior of transition chamber 15 and to the interior of shipping container 1, it being necessary simply to interconnect the device 32 and to open the manually controllable valve 33 as the parts are assembled.

For the purpose of controlling the process, it is necessary that the contents of dispenser vessel 18 be determinable. Toward this end weighing means in the form of support links such as those schematically represented at 36 and 37 are connected at their upper ends with the support structure 13 and 14 and at their lower ends through pivots 38 and 39 with the cross arms 40 and 41 which in turn are secured at pivots 42 and 43 with support lugs 44 and 45 respectively which are secured to the outer surface of dispenser vessel 18. The inner ends of arms 40 and 41 are interconnected by link 46 which is connected at pivots 47 and 48 with arms 40 and 41 respectively and a vertical link 49 is connected to scale transmitter device 50 which is of conventional construction and which affords a visual or other indication of the weight of the dispenser vessel 18 and its contents.

Since the weight of the dispenser vessel 18 is a variable quantity, it follows that its disposition relative to the support structure 13 and 14 is also variable vertically so that in order properly to interconnect the outlet 52 of the transition chamber 15 with the valve 17 leading into the dispenser vessel 18, it is necessary to provide a yieldable coupling means generally designated at 16. Such yieldable coupling means comprises a diaphram constructed of rubber or other flexible material designated by the numeral 54 which is secured in fluid-tight relation by clamping rings 55, flange 56 and bolts 57 with the housing 58. The inner part of diaphram 54 is provided with a central aperture 59 which in turn is clamped by clamping ring 60 with the flange 61 of transition chamber 15 via bolts 62. Since the diaphram 54 is flexible, it is obvious that vertical movement of dispenser vessel 18, its valve 17 and of the housing 58 of yieldable coupling means 16 may be accommodated relative to the fixed transition chamber 15.

For the purpose of agitating the powdered reagent within shipping container 1, diffusing devices 65 and 66 are secured to the inner surface of shipping container 1 and are interconnected with conduit 31 and serve to divert the pressurized gas in various directions so that the entire interior of shipping container 1 is agitated by the flow of gas. These diffusing devices 65 and 66 are of known construction and may simply include a tray-like housing structure in which pads are mounted and which provide a plurality of random conduits for the flow and direction of pressure gas into the powdered reagent. This action prevents "bridging" of the reagent and facilitates its flow through the valve 3 during supply of material from container 1 and into dispenser vessel 18. Of course the valve 17 of dispenser vessel 18 and the valve 3 of shipping container 1 must be opened. Opening of valve 17 may be effected by any suitable means such as the pneumatically controlled operating element 70 supplied with pressure gas through conduits 71 and 72 in known manner and valve 3 may be operated manually by device 4 or by pressure gas supplied by conduits 6 and 7.

With pressure supplied through valve 27 and conduit 31 to the shipping container 1 and with valves 3 and 17 opened, powdered reagent is supplied downwardly through the material handling opening at the bottom of shipping container 1 into the inlet of transition chamber 15 through the outlet of transition chamber 15 through valve 17 and into dispenser vessel 18. The amount of material supplied from dispenser vessel 18 may be observed and controlled by means of the weighing mechanism including scale transmitter 50.

The supply of pressure fluid through conduit 31, quick disconnect device 32, and valve 33 to shipping container 1 not only serves to agitate the powdered reagent of shipping container 1 but also serves to replace the material discharged from the shipping container 1 and by this means further facilitates the efficient and safe supply of powdered reagent from the shipping container 1 to the dispenser vessel 18 in a positive and controlled manner.

INDUSTRIAL APPLICABILITY

From the above description, it is apparent that the invention is primarily intended for use in conjunction with the desulfurization of molten ferrous metal. It is also obvious however that the invention may be applied for other specific uses where the additive such as powdered reagent must be isolated from atmospheric air and moisture.

The embodiments of the invention in which an exclusive property or privilege is claimed are defined as follows:

1. Apparatus for discharging powdered reagent from a shipping container having a material handling passage through its wall, said apparatus comprising support structure, a transition chamber mounted on said support structure and having an inlet at its upper part and an outlet at its lower part and arranged so as to support the shipping container with its material handling passage in communication with said inlet, weighing means supported by said support structure, a dispenser vessel suspended from and supported by said weighing means and having an entry opening adjacent said outlet of said transition chamber, and yieldable coupling means interconnecting said outlet and said entry opening for maintaining a fluid-tight connection therebetween irrespective of the weight of said dispenser vessel or of its disposition relative to said support structure, wherein said shipping container includes a support base having a circular lower part and wherein said transition chamber includes a base plate having a central inlet and upwardly extending and outwardly inclined guide means spaced radially outward of said inlet for engaging said circular lower part of said shipping container so as to position said shipping container in substantially coaxial relation with said transition chamber, and wherein a resilient sealing ring is interposed between said base plate on said transition chamber and a flange of said shipping container to form a fluid tight joint therebetween.

2. Apparatus according to claim 1 wherein a source of gas under pressure is connected with said shipping container and with said transition chamber by conduit means controlled by a common valve controlled by control means engageable with a part of said shipping container.

3. Apparatus according to claim 2 wherein said common valve is controlled by control means engageable with a part of said shipping container and wherein said common valve is opened by said control means when said shipping container is disposed upon and supported by said transition chamber.

4. Apparatus according to claim 2 wherein gas diffusion means is fixedly secured to and disposed inside said shipping container and in communication with said conduit means.

5. Apparatus according to claim 2 wherein said shipping container is provided with an exhaust valve arranged to control its material handling passage and wherein means for opening said exhaust valve are provided.

6. Apparatus according to claim 5 wherein gas supplied to said shipping container through said conduit means replaces powdered reagent supplied to said transition chamber from said shipping container and simultaneously agitates the powdered reagent within said shipping container thereby to facilitate discharge of powdered reagent from said shipping container.

7. Apparatus according to claim 1 wherein disjointable clamping means mounted on said transition chamber and engageable with a part of said shipping container is arranged to impart sealing pressure to said sealing means.

8. In combination, a transition chamber having a material inlet at its upper part and a gas inlet at another part, support structure on which said transition chamber is mounted, a fluid-tight shipping container for transporting powdered reagent material and having a material handling passage through its lower part and a gas inlet port in another part, a mobile hoist for placing said shipping container on said transition chamber, valve means controlling the opening and closing of said material handling passage, a source of inert gas under pressure, conduit means interconnecting said source of inert gas under pressure with said gas inlet and said gas inlet port, a normally closed control valve in said conduit means and arranged to control the flow of gas to both said transition chamber and said shipping container, and control means engageable with a part of said shipping container and operable in coordination with the mounting of said shipping container on said transition chamber for opening said control valve.

9. The combination of claim 8 wherein a control valve is arranged to control the flow of gas through said gas inlet port.

10. The combination of claim 8 wherein said conduit means is interconnected with said normally closed control valve by a disjointable connection.

11. The combination of claim 8 wherein said transition chamber is provided with guide means arranged to engage said shipping container so as to align said material handling passage with said material inlet.

12. The combination of claim 8 wherein yieldable sealing means is interposed between said shipping container and said transition chamber in such manner as to provide a fluid-tight junction between said material handling passage and said material inlet.

13. Apparatus for discharging powdered reagent from a shipping container having a material handling passage through its wall, said apparatus comprising support structure, a transition chamber mounted on said support structure and having an inlet at its upper part and an outlet at its lower part and arranged so as to support the shipping container with its material handling passage in communication with said inlet, said shipping container having a support base including a lower part and wherein said transition chamber includes a base plate having a central inlet and upwardly extending outwardly inclined guide means spaced radially outward of said inlet for engaging said lower part of said shipping container so as to position said shipping container in substantially coaxial relation with said transition chamber, and a source of gas under pressure connected with said shipping container and with said transition chamber by conduit means controlled by a common valve controlled by control means engageable with said lower part of said shipping container, said common valve being opened by said control means when said shipping container is disposed upon and supported by said transition chamber.

* * * * *